US006039089A

United States Patent [19]

Kurmis

[11] Patent Number: 6,039,089

[45] Date of Patent: Mar. 21, 2000

[54] TOOL FOR TYING CABLE HARNESSES

[75] Inventor: Viktor Kurmis, Pinneberg, Germany

[73] Assignee: Paul Hellerman GmbH, Pinneberg, Germany

[21] Appl. No.: 09/038,458

[22] Filed: Mar. 11, 1998

[30] Foreign Application Priority Data

Mar. 11, 1997 [DE] Germany ..... 297 04 400

[51] Int. Cl.[7] ..... B21F 09/02

[52] U.S. Cl. ..... 140/93.2; 140/123.6

[58] Field of Search ..... 140/93 A, 93.2, 140/123.6

[56] References Cited

U.S. PATENT DOCUMENTS

| | | | |
|---|---|---|---|
| 3,515,178 | 6/1970 | Hidassy | 140/93.2 |
| 3,891,012 | 6/1975 | Bakermans | 140/123.6 |
| 4,908,911 | 3/1990 | Bretti et al. | 24/16 PB |
| 5,205,328 | 4/1993 | Johnson et al. | 140/93.2 |
| 5,595,220 | 1/1997 | Leban et al. | 140/123.6 |

FOREIGN PATENT DOCUMENTS

| | | | |
|---|---|---|---|
| 0 297 337 A1 | 1/1989 | European Pat. Off. | B65B 13/02 |
| 0 261 697 B1 | 9/1991 | European Pat. Off. | B65B 13/02 |
| 0 722 885 A1 | 7/1996 | European Pat. Off. | B65B 13/02 |

*Primary Examiner*—Lowell A. Larson
*Attorney, Agent, or Firm*—Alix, Yale & Ristas, LLP

[57] ABSTRACT

A tool for tying articles, in particular cable harnesses, by means of tapes. The tool comprises a tape advance channel (12), which is bounded on one side by a tool body (2) and on the other side by a step feeder for feeding a magazine strip containing the tapes alongside one another. According to the invention, the step feeder and the tool body (2) are designed to be easily separable from each other. In particular, the step feeder can be folded down from the tool body (2).

4 Claims, 1 Drawing Sheet

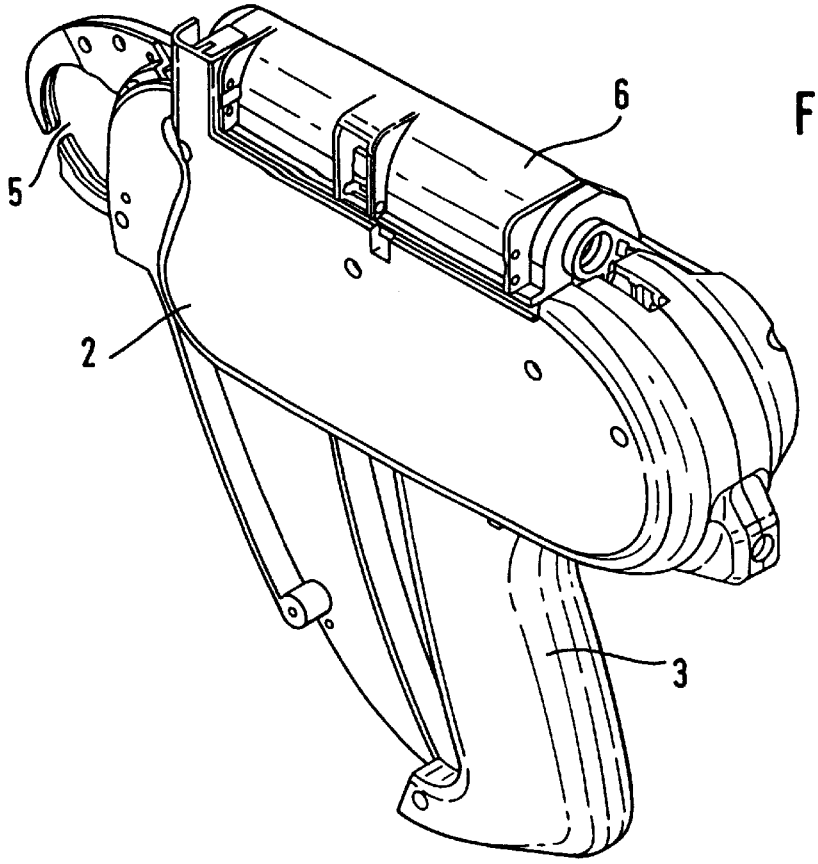
Fig. 1
Fig. 2
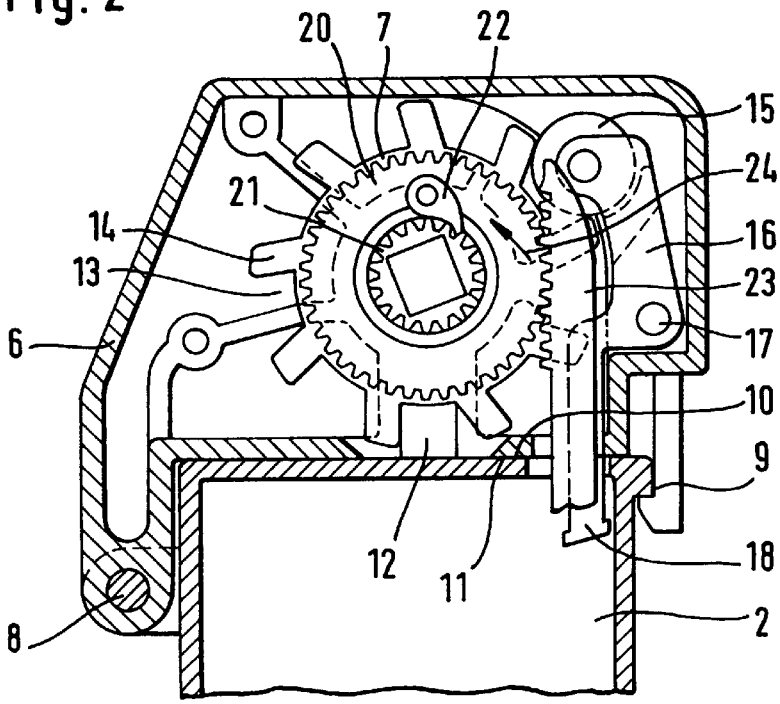

TOOL FOR TYING CABLE HARNESSES

BACKGROUND OF THE INVENTION

The invention relates to a tool for tying articles, in particular cable harnesses.

Known cable-tying tools (EP-B 261 697) contain a tape advance channel for advancing a tape toward the article to be tied. The tape advance channel is bounded on one side by a step feeder which is intended to pull in a magazine strip that contains the tapes alongside one another. It is also known to configure part of the tool body to be able to fold down in such a way that the region in which the magazine strip is fed to the tape advance channel becomes accessible. This is intended to make it possible to eliminate any faults.

SUMMARY OF THE INVENTION

The invention is based on the object of providing a tool in which the regions at risk of faults are more easily accessible.

The inventive solution consists in the step feeder and the tool body to be easily separable from each other. Expressed in another way, the parting surfaces that become accessible after one tool part has been lifted off the other are placed through the tape advance channel.

The step feeder can preferably be folded down from the tool. It expediently comprises a housing that is removably connected to the tool body or can be folded down from it, a pulling-in drum having projections on the circumference that grip between successive tapes on the magazine strip, and a latching device for securing the pulling-in drum in a rest position. The latching device is intended to ensure that the pulling-in drum always has the same position as previously following the removing or folding down of the step feeder from the tool body.

All the devices serving for the drive are expediently combined in the tool body. This means that the drive movement for the pulling-in drum has to be transferred from the tool body to the step feeder. For this, provision is expediently made for pairs of cams, that is to say a cam arranged on the tool body imparts a movement to a cam provided on the step feeder. This also includes toothing which in each case contains a multiplicity of such cams (teeth) one behind another. A design in which a rack projects from the tool body, transversely with respect to the parting surface, into the region of a gear wheel that is arranged on the step feeder and rotationally connected to the pulling-in drum only in the advance direction is particularly advantageous.

The cam or toothing engagement is intended to be configured in such a way that the position of the pulling-in drum does not alter as a result of the relative movement of the cams in relation to one another that takes place when the step feeder is folded down from the tool body. When this relative movement of the gear wheel takes place in the direction which is not the advance direction, this is inconsequential, since in this direction said gear wheel does not exert any rotational drive on the drum. In the other direction, it should be able to rotate only during the opening movement, in order that, following the opening, the latching device can bring the drum back once more into the correct position. Instead of this, provision can also be made for the direction of the cooperating flanks of the pair of cams to extend approximately in the direction of an arc of a circle about the folding axis of the step feeder, so that the flanks slide along parallel to each other or are distanced from each other when the step feeder is being pivoted back toward the tool body.

BRIEF DESCRIPTION OF THE DRAWING

The invention is explained in more detail below with reference to the drawings, which illustrate an advantageous exemplary embodiment. In the drawings:

FIG. 1 shows a perspective overall view of the tool; and

FIG. 2 shows a cross-section through the upper region of the tool.

DESCRIPTION OF A PREFERRED EMBODIMENT

The tool 1 comprises an elongate tool body 2, which can be held like a pistol by means of a handgrip 3 and whose tying function is triggered by means of a lever or slide provided on the handgrip 3. At the front end, it carries wrapping tongs 5, which lead the respective tape around the article to be tied. On the back of the tool body 2, inside a special drum housing 6, a pulling-in drum 7 is rotatably mounted parallel to the longitudinal direction of the tool body 2. The drum housing 6 is pivotably mounted on the tool body 2 at 8, the drum housing 6 and the tool body 2 being firmly connected to each other in the closed position by means of suitable latching devices 9. If the latching devices 9 are released, the drum housing 6, with the arrangement placed therein, can be pivoted down from the tool body 2. The parting surfaces 10 and 11 of the drum housing and of the tool body, respectively, which are located opposite each other in the closed state, are then exposed.

Placed in these parting surfaces 10, 11 is the tape advance channel 12, through which in each case one tape can be advanced to the wrapping tongs 5 by means of advance means (not shown) in order to wrap around an article to be tied. This channel is formed, on one side, by the tool body 2 and, on the other side, by one of the recesses 13 between circumferential projections 14 on the pulling-in drum 7. From tying operation to tying operation said drum is indexed in the clockwise direction by a drive device to be explained later, in each case by an angular interval corresponding to the pitch of the projections 14, in order in each case to bring a new tape into the ready-to-tie position in the advance channel 12. The tapes are held within a magazine strip (not illustrated) and, in a known way, are separated from one another or from a continuous strand connecting them during their feed path in the recesses 13 of the drum 7.

The correct location of the tape in the tape advance channel depends on the position of the pulling-in drum 7. Provision is therefore made for a latching device which secures the correct rest position of the pulling-in drum. This latching device is formed, on one side, by the projections 14 of the drum and, on the other side, by a roller 15 which is arranged on a lever 16 that is pivotable about a fixed axis 17 on the drum housing and is loaded by spring force in the counterclockwise direction. Said lever may be provided with an extension 18 which, in the present case, projects into the region of the tool body 2, in order there to cooperate with a limit switch or the like, which establishes the correct latching position of the lever 16 and hence also the correct rest position of the pulling-in drum 7 and, in the event of an incorrect position, stops the tool.

Mounted on the pulling-in drum 7, coaxial with it, is a gear wheel 20, which is rotatable with respect to the drum 7. Nonrotatably connected to the drum is a gear wheel 21, in whose toothed circumference there engages a pawl 22 that is firmly connected to the gear wheel 20. A rack 23, which projects up out of the tool body into the region of the drum, engages in the teeth of the gear wheel 20. Said rack is driven to and fro in order to effect the stepping advance of the pulling-in drum. If it moves downward, it rotates the gear wheel 20 in the clockwise direction. Since, in this direction of rotation, the gear wheels 20, 21 are rotationally fixedly connected to each other by the pawl 22, the drum also rotates, one of its projections moving through underneath the latching roller 15. This roller then latches again between the next pair of projections. The lifting movement of the rack 23 is inconsequential for the pulling-in drum, since in this case the gear wheel 20 that is moved in the counterclockwise direction is not rotationally connected to the gear wheel 21.

If the drum housing 6 is folded away from the tool body 2 about the folding axis 8, then the teeth of the gear wheel 20 that are in engagement with the rack 23 are moved in the direction of arrow 24; this is the direction of an arc of a circle about the axis 8. When the upper flanks of the teeth of the gear wheel 20 and the lower flanks of the rack teeth extend approximately in the direction of the arrow 24, they slide along parallel to one another during the folding movement without any mutual displacement which is considerable in practice occurring. The pulling-in drum 7 and the rack 23 are therefore able to maintain their mutual position when the drum housing is folded down or closed once more. If this geometrical condition is not satisfied, and during the opening the gear wheel 20 is rotated a little in the clockwise direction, this does not matter, since the drum is rotated back directly into the rest position by the latching device 14, 15 as soon as the teeth of the rack 23 and of the gear wheel 20 are no longer in engagement with one another. During the folding-back operation, it may occur that a tooth of the gear wheel 20 does not get into the tooth gap of the rack 23 in which it had been before the folding-open operation and the gear wheel 20 is rotated a little in the counterclockwise direction. However, this has no effect on the drum position, since in this direction it is not rotationally connected to the gear wheel 21.

I claim:

1. A tool for tying articles by means of tapes comprising a tape advance channel for advancing a tape, a tool body forming one side of said channel and a step feeder for feeding a magazine strip to the tape advance channel, and forming the other side of said channel, the step feeder and the tool body being movable from each other to provide ready access to said channel, wherein the step feeder comprises a housing that is removably connected to the tool body, a pulling-in drum having projections on the circumference that grip between successive tapes on the magazine strip, and a latching device for securing the pulling-in drum in a rest position.

2. The tool as claimed in claim 1, wherein the step feeder can be folded down from the tool body (2).

3. The tool as claimed in claim 1, comprising a drive for the step feeder arranged on the tool body (2), and operatively interengaging drive transmission members connected to the drive for the transmission of the drive movement from the tool body to the step feeder.

4. The tool as claimed in claim 3, comprising a gear wheel (20) arranged drivably on the step feeder and rotationally connected to the pulling-in drum (7) and a rack projecting from the tool body for engaging the gear wheel for driving the drum only in one direction.

* * * * *